US006679737B1

(12) United States Patent
Meiners et al.

(10) Patent No.: US 6,679,737 B1
(45) Date of Patent: Jan. 20, 2004

(54) REMOVABLE CLAMP FOR NETWORK PROTECTOR BUS

(75) Inventors: Steven E. Meiners, Beaver Falls, PA (US); Arthur J. Jur, Aliquippa, PA (US); Douglas M. Brandt, Ellwood City, PA (US); Stephen W. Oneufer, Cranberry Township, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/209,575

(22) Filed: Jul. 31, 2002

(51) Int. Cl.[7] ..... H01R 4/50
(52) U.S. Cl. ..... 439/806; 24/514
(58) Field of Search ..... 439/213, 796, 439/806; 24/135 R, 514, 569

(56) References Cited

U.S. PATENT DOCUMENTS 2,421,257 A * 5/1947 Genter ..... 439/806
5,011,421 A * 4/1991 Duke et al. ..... 439/213
5,530,205 A 6/1996 Parks et al.

* cited by examiner

*Primary Examiner*—Neil Abrams
(74) *Attorney, Agent, or Firm*—Martin J. Moran

(57) ABSTRACT

A removable clamp assembly for a network protector bus, the network bus having at least one opening therethrough. The clamp assembly is structured to couple the network protector bus to a vault bus. The clamp assembly includes a mounting bracket structured to be removably coupled to the network protector bus and a gripping assembly for selectively gripping the vault bus. The gripping assembly is coupled to the mounting bracket. The gripping assembly includes threaded tubes surrounding a rod with opposite threads at each end for driving the tubes, whereby the gripping fingers on the gripping assembly are movable to grip the vault buss blocks.

17 Claims, 7 Drawing Sheets

REMOVABLE CLAMP FOR NETWORK PROTECTOR BUS

BACKGROUND OF THE INVENTION

1. Field of the Invention

This invention relates to a network protector bus clamp and, more specifically, to a network protector having a removable bus clamp assembly that may be removed from the bus without disassembling the clamp.

2. Background Information

Secondary power distribution networks consist of interlaced grids which are supplied by two or more sources of power so that the loss of a single source of power will not result in an interruption of service. Such secondary power distribution networks provide the highest level of reliability possible with conventional power distribution and are normally used to supply high-density load areas such as a section of a city, a large building, or an industrial site. Between a power source and the network is a transformer and a network protector. The network protector consists of a circuit breaker and a control relay. The circuit breaker includes at least one set of main contacts that move between an open position and a closed position. When the main contacts are closed, electricity may flow through the network protector. The control relay senses the transformer and network voltages and line currents and executes algorithms to initiate breaker tripping or closing action. Trip determination is based on detecting an overcurrent condition or reverse power flow, that is, power flow from the network to the energy source. Network protectors are often found in dust-proof or moisture-proof housings, or vaults, which are disposed in subterranean passageways in large metropolitan areas.

The network protector circuit breaker has at least one line bus and a load bus. Typically, the circuit breaker is a three phase circuit breaker having three poles, each with a line bus and a load bus. The network protector busses are coupled, respectively, to a vault line bus and a vault load bus. Either the vault line bus or the vault load bus will include a fuse located on the line opposite the clamp. The network protector circuit breaker bus that is coupled to the vault bus having the fuse uses a clamp assembly to couple the network protector circuit breaker bus to the vault bus. The vault bus also terminates in a coupling block. The clamp assembly includes a plurality of gripping fingers that are structured to move between a closed position, wherein the clamp assembly engages the coupling block, and an open position, wherein the clamp assembly does not engage the coupling block. When the clamp assembly is not engaging the coupling block, and after other connections are separated the circuit breaker may be rolled out of the vault. After the repair or maintenance operations are complete, the circuit breaker is moved into the vault and the fingers are moved into the closed position, gripping the coupling block.

It is a priority for utility companies, and other users, to reduce the down time of the network protector during repair. One way to reduce the down time is to simply replace the network protector. The difficulty in replacing a network protector is that the replacement unit must have a clamp assembly that is structured to interact with the vault bus in the vault that houses the network protector. The shape of the vault busses vary depending on whether the bus fuse is located on network side or the transformer side of the circuit breaker. Additionally, prior art clamps were designed to be attached to five inch tubular bus sections. Current network protectors have laminated rectangular busses which are about two inches thick. Moreover, the prior art bus clamp must be completely disassembled during the removal procedure. That is, the mounting assembly for the clamp assembly must be engaging the network protector bus to hold the clamp assembly together. As such, to remove the clamp assembly, the clamp assembly must be disassembled during the removal procedure and reassembled during the installation procedure. The disassembly and reassembly of the clamp assembly causes delay in the maintenance and/or repair procedure.

There is, therefore, a need bus clamp assembly that is structured to engage a laminated bus.

There is a further need for a bus clamp assembly that can be easily removed from, and reinstalled on, a laminated bus.

There is a further need for a bus clamp assembly that is compatible with existing equipment.

SUMMARY OF THE INVENTION

These needs, and others, are satisfied by the invention which provides a bus clamp assembly having a mounting bracket that is structurally separate from, but coupled to, a gripping assembly. The gripping assembly provides the clamping function for attaching the network protector bus to the line conductor or the load conductor. The mounting bracket attaches the clamp assembly to the network protector bus. The bracket may be attached or removed from the network protector bus without disassembling the gripping assembly.

The mounting bracket is an L-shaped body having a first leg and a second leg. The first leg has a plurality of openings. The first leg openings are structured to align with openings on the network protector bus. As such, a fastening device, e.g. bolts, may be passed through the first leg openings and the network protector bus. Nuts are coupled to the bolts thereby attaching the bracket to the bus. The second leg of the bracket has one or more openings as well. The second leg opening cooperates with a fastening device to couple the bracket to the gripping assembly. The fastening device passing through the second leg and coupling the bracket to the gripping assembly remains in place as the first leg fastening devices are removed or installed. As such, the griping assembly does not have to be assembled or disassembled as the clamp assembly is coupled or de-coupled from a network protector bus.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

Figure 1:
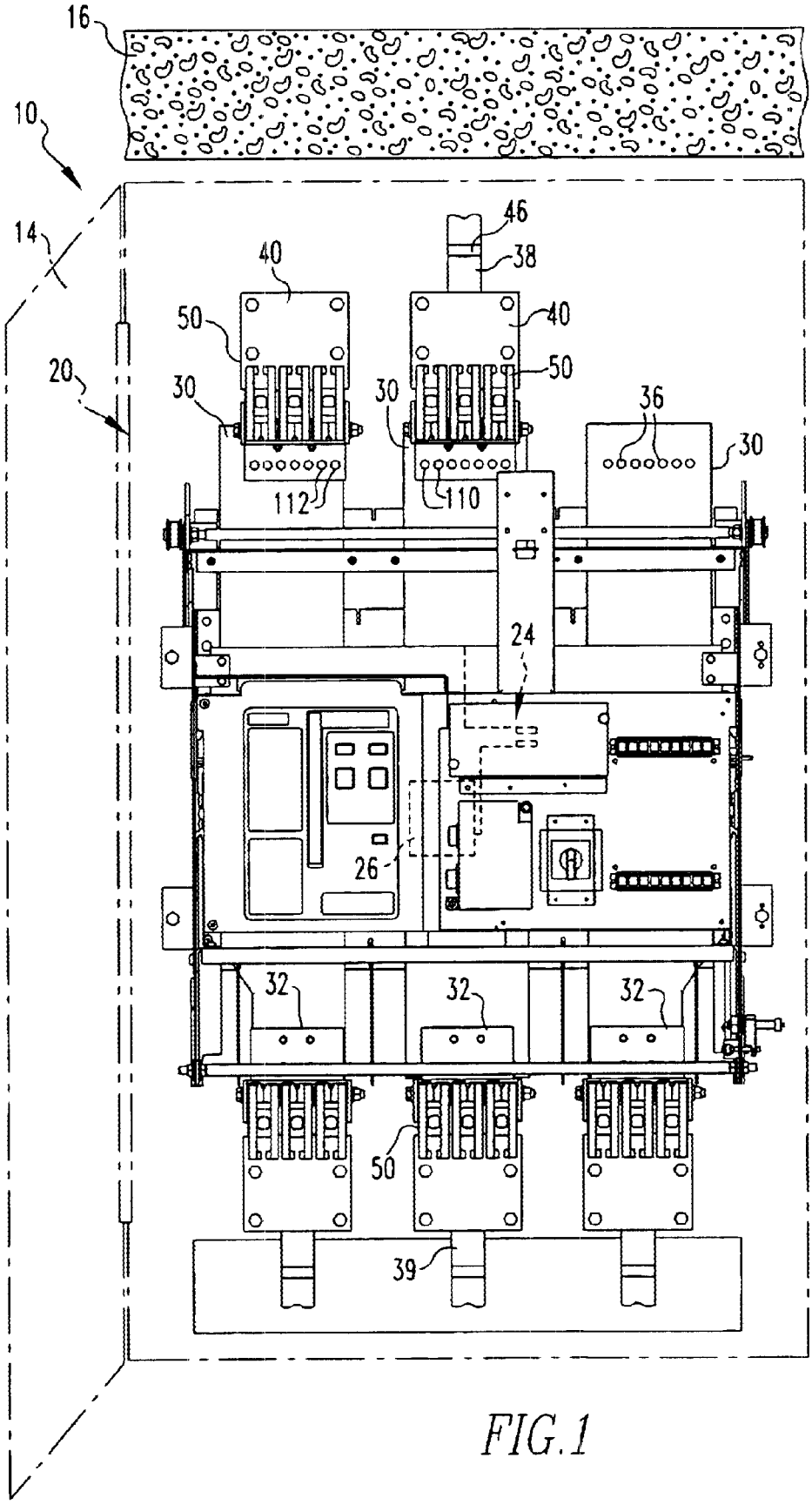
FIG. 1 is a front view of a network protector incorporating the invention and showing internal components schematically.
Figure 2:
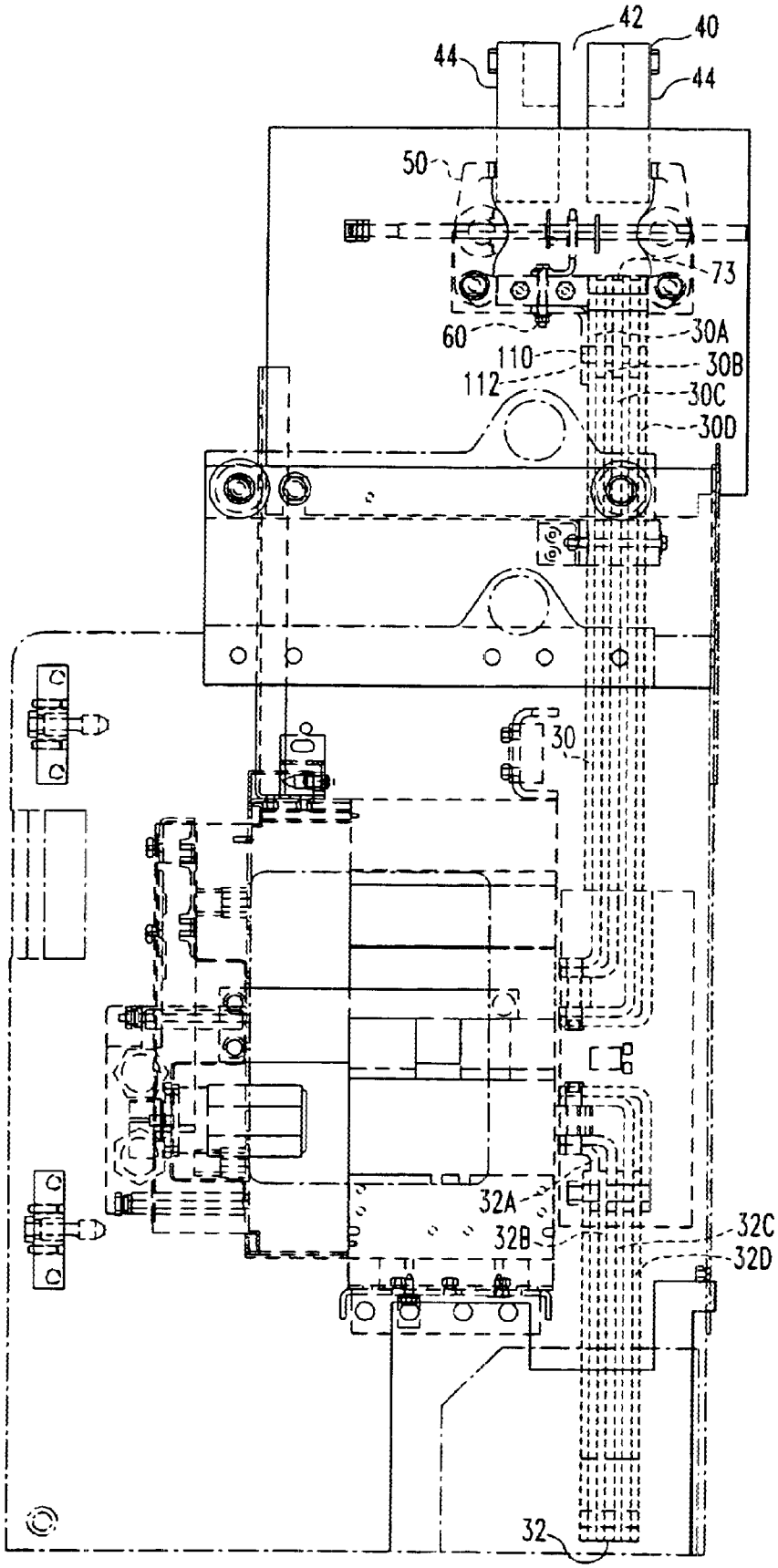
FIG. 2 is a side view of a network protector circuit breaker from FIG. 1.
Figure 3:
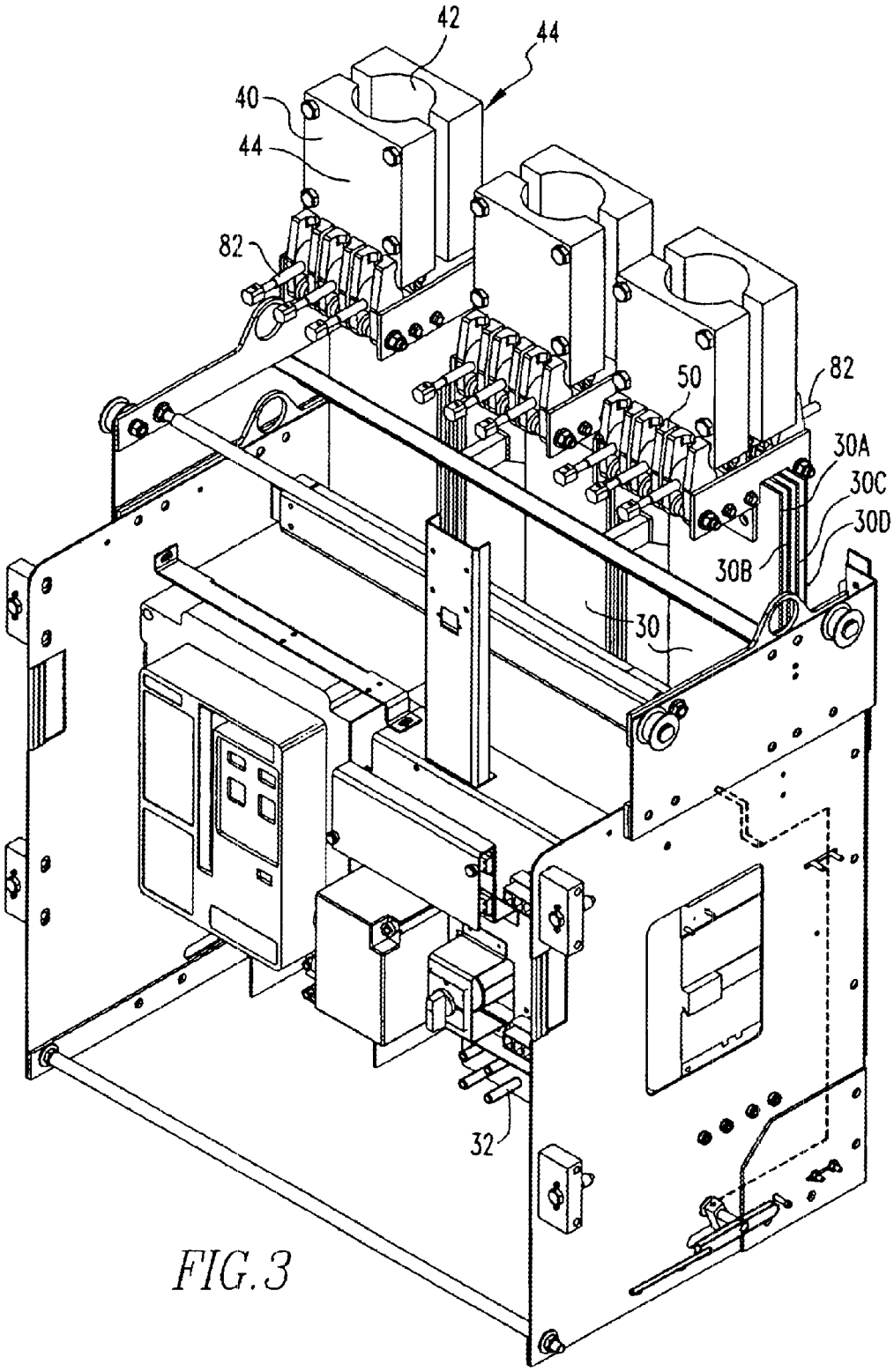
FIG. 3 is an isometric view of a network protector circuit breaker from FIG. 1.

As shown in FIG. 1, a network protector 10 includes a tank 12 which includes a movable door 14. The tank 12 is structured to be placed within a vault 16. A vault is typically made of concrete or a similar material. The two primary network protector components, a circuit breaker 20 and a relay 22 are disposed within the tank 12. The circuit breaker includes at least one set of main contacts 24 (shown schematically) that are structured to move between a first, open position and a second closed position. When the main contacts 24 are in the second, closed, electricity may flow through the circuit breaker 20. When the main contacts 24 are in the first, open position, electricity cannot flow through the circuit breaker 20. The circuit breaker 20 also includes an operating mechanism 26 (shown schematically) that is structured to move the main contacts 24 between the first and second position. The main contacts 24 are coupled to one or more network protector line buses 30 and one or more network protector load buses 32. In a preferred embodiment, shown in FIGS. 1–3, the circuit breaker 20 is a three phase circuit breaker having three poles. Each pole includes a line bus 30 and a load bus 32. As shown in FIGS. 2 and 3, both the network protector line bus 30 and the network protector load bus 32 are each made from a plurality of laminations 30A, 30B, 30C, 30D and 32A, 32B, 32C, 32D. Each network protector line bus 30 and network protector load bus 32 has one or more sets aligned openings 36 in each lamination 30A, 30B, 30C, 30D and 32A, 32B, 32C, 32D. The network protector line bus 30 and the network protector load bus 32 are each structured to be coupled to a clamp assembly 50, described below. The network protector line bus 30 is coupled to a vault line bus 38 and the network protector load bus 32 is coupled to a vault load bus 39. Both the vault line bus 38 and the vault load bus 39 include a coupling block 40. The coupling block has a generally cylindrical cavity 42 structured to engage the generally cylindrical vault line bus 38 or vault load bus 39. The outer surfaces 44 of the coupling block 40 are generally flat. Either the vault line bus 38 or the vault load bus 39 has a fuse 46 located therein. The mounting block is located on the line, 38, 39 having the fuse 46.

As shown in FIGS. 4–7, the clamp assembly 50 includes a mounting bracket 60 and a gripping assembly 70. The mounting bracket 60 includes an L-shaped body 62 having a first planar leg 64 and a second planar leg 66. The bracket first leg 64 and the bracket second leg 66 are joined at a vertex 61 and are, generally, perpendicular to each other. The bracket first leg 64 includes at least one opening 65 extending through the planar member. When there are a plurality of bracket first leg openings 65, the openings 65 are disposed, generally, in a line extending across the planar member. The bracket first leg openings 65 are sized and spaced to align with bus lamination openings 36. The bracket second leg 66 also includes one or more openings 67. The bracket second leg openings 67 are aligned with medial openings 77, described below, on the gripping assembly 70.

The gripping assembly 70 includes two planar side members 72, 74, a spacer 76, a support 78, at least one threaded rod 80, at least one threaded shell 82, at least one shell spring 83, at least two hubs 84, 86, and at least one set of opposed gripping fingers 88, 90. The side members 72, 74 each have a notch 73 sized to accommodate the network protector laminated busses 30, 32. The side members 72, 74 each have pivot openings (not shown) for pivot rods 94, 96, described below, and fastener openings (not shown) for fasteners 92, described below. The spacer 76 is a generally rectangular block disposed between the side members 72, 74. The spacer 76 has threaded openings on the sides adjacent to the side members 72, 74. A plurality of fasteners, such as, but not limited to, bolts 92 extend through the side member fastener openings and into the spacer threaded openings. Thus, the side members 72, 74 are held in a spaced relation. The spacer 76 also has one or more, preferably two, medial openings 77 extending between the faces that are, generally, parallel to threaded rod 80.

Figure 4:
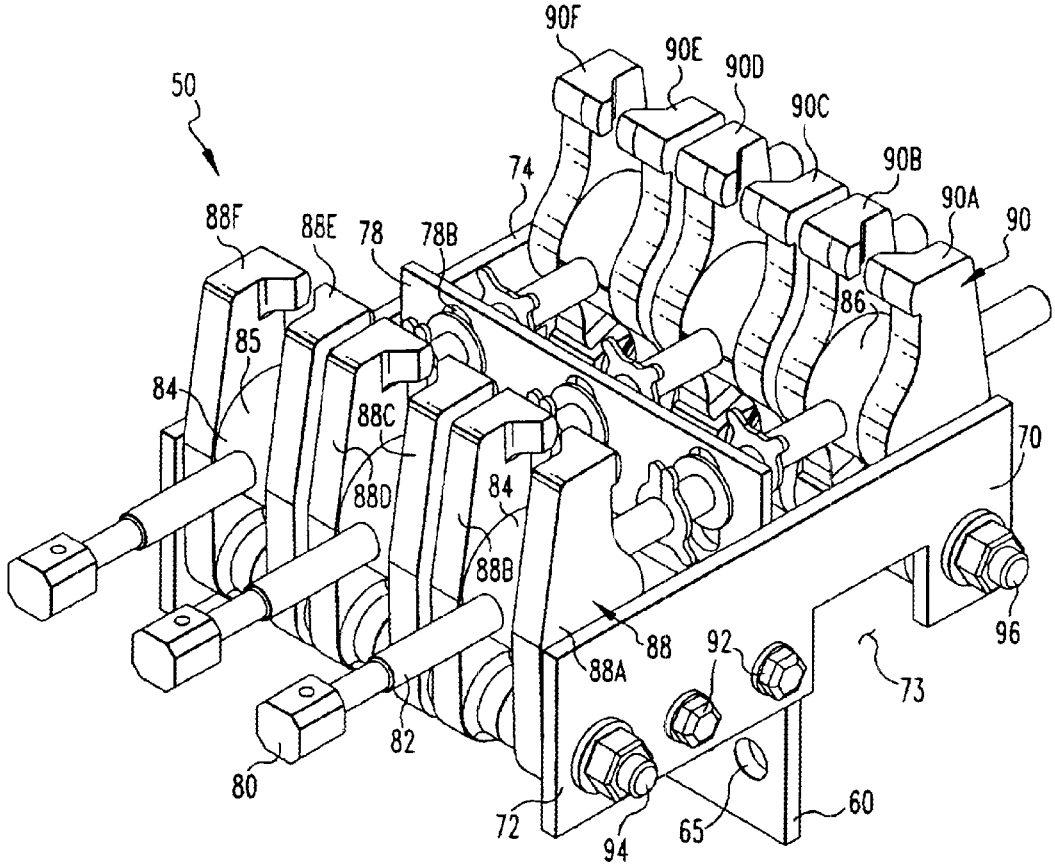
FIG. 4 is an isometric view of a clamp assembly.
Figure 5:
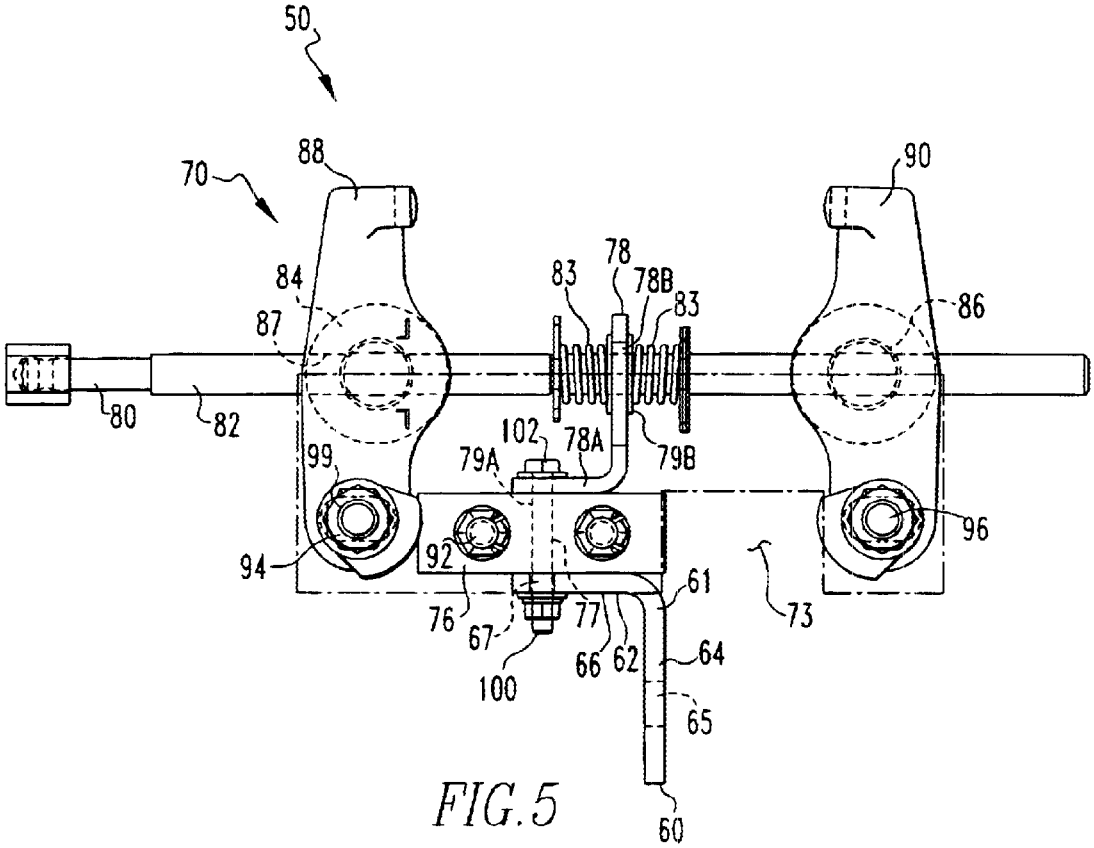
FIG. 5 is a side view of a clamp assembly.
Figure 6:
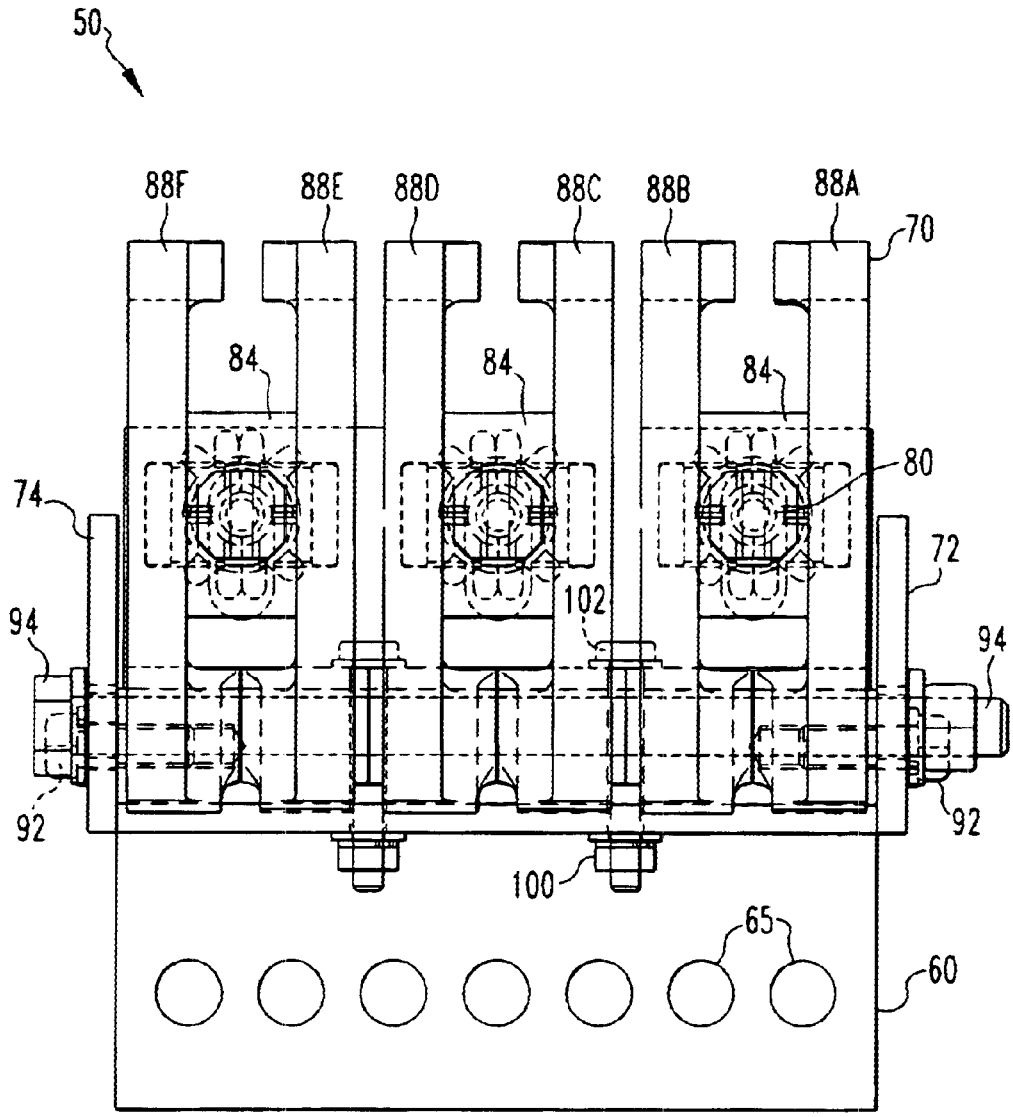
FIG. 6 is a front view of a clamp assembly.
Figure 7:
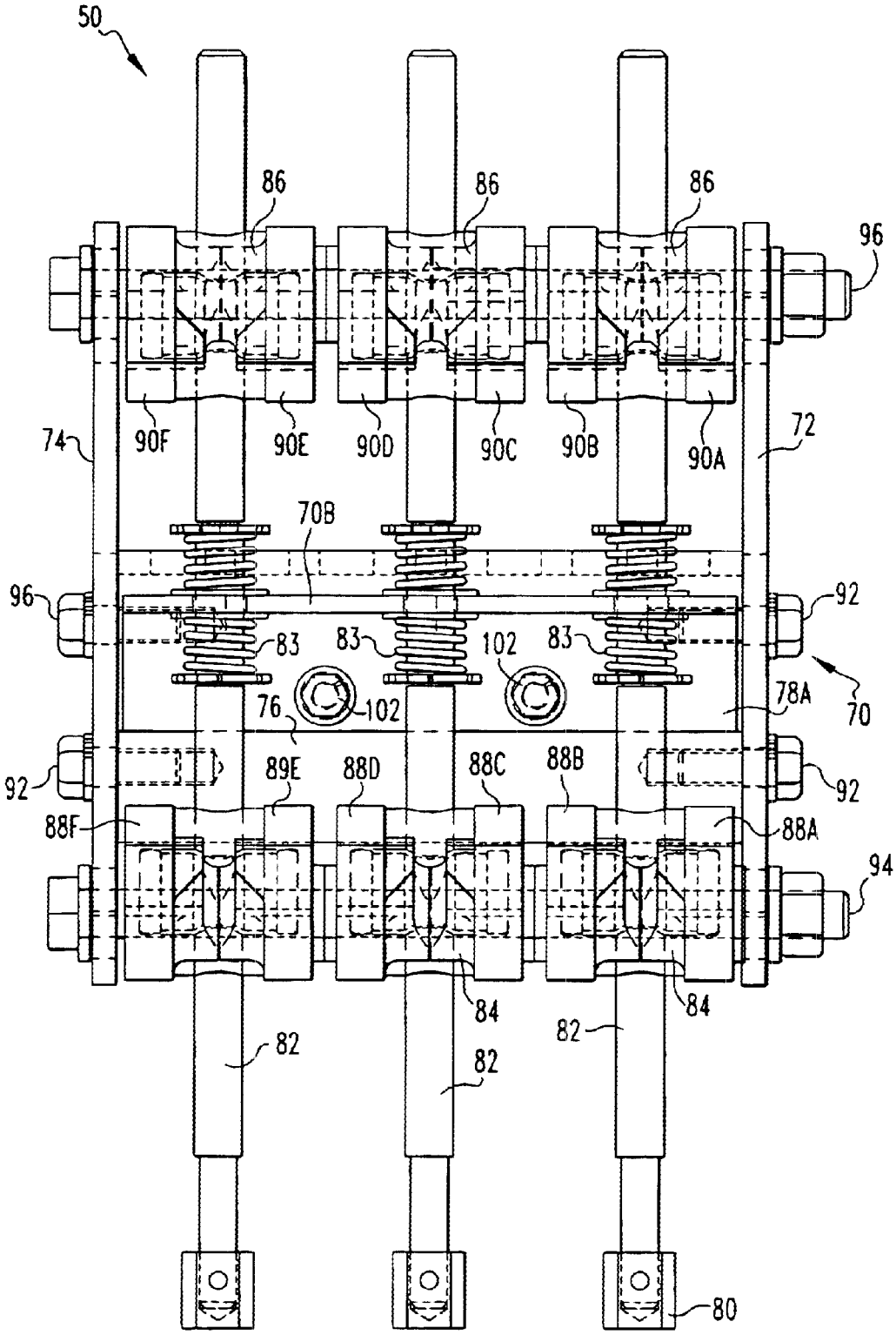
FIG. 7 is a top view of a clamp assembly.

Pivot rods 94, 96 pass through the side member pivot openings and are rotatably supported between the side members 72, 74. The gripping fingers 88, 90 are mounted on the pivot rods 94, 96, one finger 88, 90 on each pivot rod 94, 96. As such, the gripping fingers 88, 90 form an opposed pair. The pair of fingers are structured to pivot between a first, closed position and a second, open position, as described below. A hub 84, 86 is rotatably coupled to each finger 88, 90. The hub 84, 86 includes a generally cylindrical body 85 having a radial opening 87 therethrough. In a preferred embodiment, there are a plurality of fingers 88A, 88B, 88C, 88D, 88E, 88F and 90A, 90B, 90C, 90D, 90E, 90F. A hub 84, 86 is disposed between and coupled to a set of two fingers 88, 90. For example, as shown in FIG. 4, hub 84A is disposed between, and coupled to, fingers 88A and 88B. To rotatably couple the hub 84A between fingers 88A and 88B, the fingers 88A and 88B may be formed each with a circular recess (not shown). The hub 84A is rotatably disposed in the recess. When the fingers 88A and 88B are attached to the pivot rod 94, as described below, the hub 84A is secured in the recess.

The support 78 has, generally, an L-shape with a first leg 78A and a second leg 78B. The support first leg 78A has one or more openings 79A extending therethrough. The support first leg openings 79A are sized and spaced to correspond to spacer medial openings 77. The support second leg 78B has at least one slot shaped opening 79B extending therethrough. The support second leg opening 78B is slot shaped to accommodate the movement of the rods 80 as the fingers 88, 90 move between the open and closed position. Each support second leg opening 79B is also aligned with a hub radial opening 87.

When assembled, spacer 76 holds the side members 72, 74 in a spaced relation. The side members 72, 74 rotatably support the pivot rods 94, 96. The pivot rods 94, 96 support one or more fingers 88, 90. The fingers 88, 90 are each rotatably coupled to a hub 84, 86. Additionally, a bracket/support fastening device 100, such as, but not limited to, a bolt 102, couples both the mounting bracket 60 and the support 78 to the spacer 76. The bracket/support fastening device 100 passes through the spacer medial openings 77. The support 78 is positioned so that the support second leg opening 79B is aligned with the hub radial openings 87. Thus, a threaded rod 80 may pass through the hub 84 coupled to finger 88, through the support second leg opening 79B, and through the hub 84 coupled to finger 90. Two threaded shells 82 engage the threaded rod 80, one threaded shell on each side of the support 78. The threaded shells 82 are each fixed to a hub 84, 86. That is, the threaded shells 82 cannot move axially through the hub radial openings 87. The threaded shells 82 are also coupled to the shell springs 83, which are disposed between the threaded shells 82 and the support second leg 79. The threaded rod 80 is structured with clockwise threads on one side of the support 78 and counter-clockwise threads on the opposite side of the support 78. In this configuration, rotating the threaded rod 80 will cause the threaded shells 82 to move toward or away from each other. As the threaded shells 82 are fixed to the hubs 84, 86, which are in turn rotatably coupled to the fingers 88, 90, rotating the threaded rods 80 cause the fingers 88, 90 to move between the first, closed position and the second, open position.

As shown best in FIG. 2, the clamp assembly 50 is coupled to a circuit breaker bus 30, 32 using the mounting bracket 60. That is, fasteners 110, such as, but not limited to, a bolt 112 is passed through the bracket openings 65 (FIG. 5) and the bus openings 36 (FIG. 1). The bus 30, 32 is disposed in notch 73. If there are multiple bracket openings 65 disposed longitudinally across the bracket first leg 64, the clamp assembly 50 may be centered on the bus 30, 32, or may be shifted to one side of the bus 30, 32, as shown in FIG. 1, or the other as needed to align with the vault line bus 39 or vault load bus 39. Moreover, because the clamp assembly fasteners 110 are not required to hold the clamp assembly 50 together, the clamp assembly 50 may be removed or installed as a unit without disassembling the gripping assembly 70.

In operation, for example, the circuit breaker 20 may be moved from one network protector 10 having fuses on the vault load bus 39 to a network protector having fuses on the vault line bus 38. In such a situation, the clamp assembly 50 must be moved from the network protector line bus 30 to the network protector load bus 32. The method for that procedure is as follows. After power to the network protector 10 is turned off and all appropriate safety precautions are taken, the technician rotates each threaded rod 80 on the gripping assembly 70 to move the fingers 88, 90 into the second, open position. This action will cause the gripping fingers 88, 90 to move away from the coupling block 40. The technician also uncouples the load bus 32 from the vault load bus 39 as is know in the prior art. The circuit breaker 20 is then removed from the tank 12. The technician then removed the fasteners 110 coupling the clamp assembly 50 to the line bus 38. The clamp assembly 50 then placed on the load bus 39 and the fasteners 110 are passed through the mounting bracket 60 and the load bus openings 36. After the fasteners 110 are secured, the circuit breaker 20 is placed in the new tank 12. The load bus 32 is coupled to vault load bus 39, which terminates in a coupling block 40, by placing the coupling block 40 between the gripping fingers 88, 90. The technician rotates the threaded rod 80 to move the gripping fingers 88, 90 from the second open position into the first, closed position. The technician then couples the line bus 30 to the vault line bus 38 as is known in the prior art. Thus, the clamp assembly 50 is moved from the line bus 30 to the load bus 32 without disassembling the clamp assembly 50.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A removable clamp assembly for a network protector bus, said network bus having at least one opening therethrough, said clamp assembly structured to couple said network protector bus to a vault bus, said clamp assembly comprising:

a mounting bracket structured to be removably coupled to said network protector bus;

a gripping assembly for selectively gripping said vault bus;

said gripping assembly coupled to said mounting bracket;

wherein said mounting bracket has an L-shaped body having a first leg and a second leg;

said mounting bracket first leg having at least one opening structured to align with said network protector bus at least one opening;

said mounting bracket second leg structured to be coupled to said gripping assembly;

wherein said mounting bracket first leg is a planar member;

said mounting bracket first leg includes a plurality of openings disposed in a line across said first leg planar member;

wherein said gripping assembly includes at least one pair of fingers structured to move between a first, closed position and a second, open position; and said fingers in said first, closed position structured to engage said vault bus.

2. The clamp assembly of claim 1 wherein said gripping assembly includes:

a first and second planar side member, each having two pivot rod openings;

said pivot rod openings on said first side member aligned with said pivot rod openings on said second side member;

a spacer;

said spacer disposed between said first and second side members, holding said first and second side members in a spaced relation;

two pivot rods;

said pivot rods rotatably disposed, one each, within said pivot rod openings and extending between said first and second side members;

said pair of fingers having two fingers, one finger disposed on each said pivot rods;

two hubs, each having a radial opening, one hub rotatably coupled to each said finger;

a support having an L-shaped body having a first and second leg, said second leg having an opening therethrough;

at least one threaded rod;

at least one threaded shell;

at least one threaded shell fixed to each said hub, extending through said hub opening, and coupled to said support;

said threaded rod passing through and engaging said threaded shell and passing through said support second leg opening; and said bracket coupled to said spacer.

3. A circuit breaker for a network protector structured to be coupled to a vault line bus and a vault load bus, said circuit breaker comprising:

at least one network protector line bus;

at least one network protector load bus;

a pair of separable main contacts;

said at least one network protector line bus and said at least one network protector load bus coupled to said pair of separable main contacts;

a operating mechanism structured to move said main contacts into and out of contact with each other; and a clamp assembly coupled to either said network protector line bus or said network protector load bus;

said clamp assembly comprising:

a mounting bracket structured to be coupled to a network protector bus;

a gripping assembly for selectively gripping said vault bus; and said gripping assembly coupled to said mounting bracket.

4. The circuit breaker of claim 3 wherein:

said network protector line and network protector load bus each have at least one opening extending therethrough;

said mounting bracket has an L-shaped body having a first leg and a second leg;

said mounting bracket first leg having at least one opening structured to align with said network protector bus at least one opening;

a fastener passing through said first leg at least opening and said network protector bus at least one opening, thereby coupling said bracket to said network protector line bus or said network protector load bus; and said mounting bracket second leg structured to be coupled to said gripping assembly.

5. The circuit breaker of claim 4 wherein:

said mounting bracket first leg is a planar member; and said mounting bracket first leg includes a plurality of openings disposed in a line across said planar member.

6. The circuit breaker of claim 5 wherein:

said gripping assembly includes at least one pair of fingers structured to move between a first, closed position and a second, open position; and said fingers in said first, closed position structured to engage a vault bus.

7. The circuit breaker of claim 6 wherein said gripping assembly includes:

a first and second planar side member, each having two pivot rod openings;

said pivot rod openings on said first side member aligned with said pivot rod openings on said second side member;

a spacer;

said spacer disposed between said first and second side members, holding said first and second side members in a spaced relation;

two pivot rods;

said pivot rods disposed, one each, within said pivot rod openings and extending between said first and second side members;

said pair of fingers having two fingers, one finger disposed on each said pivot rods;

two hubs, each having a radial opening, one hub rotatably coupled to each said finger;

a support having an L-shaped body having a first and second leg, said second leg having an opening therethrough;

at least one threaded rod;

at least one threaded shell;

at least one threaded shell coupled to each said hub, extending through said hub opening, and rotatably coupled to said support;

said threaded rod passing through and engaging said threaded shell and passing through said support second leg opening; and said bracket coupled to said spacer.

8. The circuit breaker of claim 6 wherein said network protector line bus and said network protector load bus each include a plurality of laminations.

9. A network protector structured to be coupled to a vault line bus and a vault load bus, said network protector comprising:

a relay;

a circuit breaker comprising:

at least one network protector line bus;

at least one network protector load bus;

a pair of separable main contacts;

said at least one network protector line bus and said at least one network protector load bus coupled to said pair of separable main contacts;

a operating mechanism structured to move said main contacts into and out of contact with each other; and a clamp assembly coupled to either said network protector line bus or said network protector load bus;

said clamp assembly comprising:

a mounting bracket structured to be coupled to a network protector bus;

a gripping assembly for selectively gripping said vault bus; and said gripping assembly coupled to said mounting bracket.

10. The network protector of claim 9 wherein:

said network protector line and network protector load bus each have at least one opening extending therethrough;

said mounting bracket has an L-shaped body having a first leg and a second leg;

said mounting bracket first leg having at least one opening structured to align with said network protector bus at least one opening;

a fastener passing through said first leg at least opening and said network protector bus at least one opening, thereby coupling said bracket to said network protector line bus or said network protector load bus; and said mounting bracket second leg structured to be coupled to said gripping assembly.

11. The network protector of claim 10 wherein:

said mounting bracket first leg is a planar member; and said mounting bracket first leg includes a plurality of openings disposed in a line across said planar member.

12. The network protector of claim 11 wherein:

said gripping assembly includes at least one pair of fingers structured to move between a first, closed position and a second, open position; and said fingers in said first, closed position structured to engage a vault bus.

13. The network protector of claim 12 wherein said gripping assembly includes:

a first and second planar side member, each having two pivot rod openings;

said pivot rod openings on said first side member aligned with said pivot rod openings on said second side member;

a spacer;

said spacer disposed between said first and second side members, holding said first and second side members in a spaced relation;

two pivot rods;

said pivot rods disposed, one each, within said pivot rod openings and extending between said first and second side members;

said pair of fingers having two fingers, one finger disposed on each said pivot rods;

two hubs, each having a radial opening, one hub rotatably coupled to each said finger;

a support having an L-shaped body having a first and second leg, said second leg having an opening therethrough;

at least one threaded rod;

at least one threaded shell;

at least one threaded shell coupled to each said hub, extending through said hub opening, and rotatably coupled to said support;

said threaded rod passing through and engaging said threaded shell and passing through said support second leg opening; and said bracket coupled to said spacer.

14. The network protector of claim 12 wherein said network protector line bus and said network protector load bus each include a plurality of laminations.

15. A method of moving a clamp assembly from one bus on a network protector circuit breaker, said circuit breaker having a line bus and a load bus, each bus having an opening therethrough, said line bus coupled to a vault line bus, said load bus coupled to a vault load bus, said method comprising the steps of:

a) providing a clamp assembly having a mounting bracket and a gripping assembly, said mounting bracket having a first planar leg and a second planar leg, said bracket first planar leg having a at least one opening therethrough, said second planar leg coupled to said gripping assembly, said bracket coupled to one network protector bus by a fastener extending through said bracket first leg at least one opening and through said bus at least one opening;

b) having said gripping assembly attached to either said vault line bus or said vault load bus and detaching said gripping assembly therefrom;

c) removing said bracket fastener;

d) removing said clamp assembly;

e) moving said clamp assembly to the other said network protector bus;

f) coupling said clamp assembly to said bus by passing a fastener through said mounting bracket first leg at least one opening and said network protector bus opening;

g) positioning either said vault line bus or said vault load bus, whichever was not previously coupled to said clamp, between the fingers;

h) attaching said gripping assembly to either said vault line bus or said vault load bus.

16. The method of claim 15 comprising the further steps of:

a) providing a first network protector vault having a fuse on the vault line bus;

b) providing a second network protector vault having a fuse on the vault load bus;

c) moving the circuit breaker between the first network protector vault and second network protector vault so that the clamp assembly positioned to be coupled to the vault bus opposite the bus having said fuse.

17. The method of claim 16 wherein said steps of detaching and attaching said gripping assembly comprises the steps of:

a) providing said gripping assembly with at least one pair of opposed fingers coupled by a threaded rod, said threaded rod structured to move said fingers between a first, closed position and a second, open position in response to rotating said rod, said fingers initially in said closed position and engaging either said vault line bus or said vault load bus;

b) rotating said rod to move said fingers into said open position to detach said gripping assembly from said vault bus;

c) after said clamp assembly is moved from one bus to the other and said circuit breaker is moved between said first vault and said second vault, rotating said rod to move said fingers from said open position to said closed position, thereby gripping said vault line bus or said vault load bus.

* * * * *